United States Patent [19]

Rosen

[11] Patent Number: 4,731,600

[45] Date of Patent: Mar. 15, 1988

[54] FUSE

[75] Inventor: Philip Rosen, Bridgeford, England

[73] Assignee: Brush Fusegear Limited, Leicestershire, England

[21] Appl. No.: 940,616

[22] Filed: Dec. 11, 1986

[30] Foreign Application Priority Data

Dec. 17, 1985 [GB] United Kingdom ..... 8531026

[51] Int. Cl.[4] ..... H01H 85/04

[52] U.S. Cl. ..... 337/159; 337/292

[58] Field of Search ..... 337/158, 159, 160, 161, 337/162, 292, 295, 296

[56] References Cited

U.S. PATENT DOCUMENTS 2,653,203 9/1953 Kozacka ..... 337/160

4,308,514 12/1981 Kozacka ..... 337/292

*Primary Examiner*—Harold Broome

*Attorney, Agent, or Firm*—Charles E. Brown; Charles A. Brown

[57] ABSTRACT

A General-Purpose or Full-Range fuse in which one or more integral fuse elements are provided a first part of the length of each element serving as a current limiting device at high fault currents and a second part of the length of each element serving as an expulsion device at lower fault currents. In a preferred embodiment the first fuse part has a plurality of constrictions such as holes or notches disposed along its length and the second part has a single constriction located in a central region thereof, the length of the constriction in the second part exceeding the length of one of the constrictions in the first part.

12 Claims, 4 Drawing Figures

EXPULSION ELEMENT CHARACTERISTIC
14
12
CURRENT-LIMITING ELEMENT CHARACTERISTIC
10
TIME (SECONDS)
CURRENT (AMPERES)

CURRENT LIMITING NOTCHES
EXPULSION LONG NOTCH
CHARACTERISTICS MERGE
20 x FUSE RATING
TIME (SECONDS)
CURRENT (AMPERES)

FUSE

The present invention relates to an improved fuse and is concerned particularly with a General-Purpose or so-called Full-Range fuse.

A known General-Purpose fuse has two parts which are electrically connected together in series relationship by way of an interconnector. One fuse part consists of a plurality of ribbon-like elements of a high conductivity metal, such as silver or copper, connected in a parallel manner. A plurality of constrictions, such as holes or notches, are provided in each element to limit the arc energy under short circuit conditions.

The second part of the fuse is arranged to melt under a lower fault condition current than the first fuse part and consists of a plurality of elements each contained within an insulating flexible sleeve, of a material such as silicone rubber. The elements of the second part may be of a low-melting point alloy or metal such as tin or, alternatively, may be silver or copper strips having a eutectic alloy overlay (known as 'M' effect) over part of its length. Both the first and second fuse parts are serially wound onto a former being connected together at their juncture by an interconnector and the whole embedded in powdered quartz.

At high fault currents, the first fuse part serves as a current limiting portion by becoming partially vapourised, absorbing fault energy by converting powdered quartz into a silver-sand slag known as 'fulgurite'. On cooling, the fulgurite attains a high electrical resistance and so the current is interrupted safely and effectively.

At lower fault currents the operating process of the first fuse part becomes ineffective and accordingly, the second fuse part interrupts the current in the manner of an expulsion fuse. In the second fuse part, melting of an element is initiated within its associated flexible sleeve and the resulting arc generates ionised gas under pressure which is expelled from the open ends of the sleeve. The de-ionisation process is assisted by the cooling effect of gas vapourised from the inner walls of the tube by the heat of the arc itself.

Fuses of the type described hereinabove, which are able to safely interrupt both high and low fault currents with equal effectiveness are termed 'General Purpose' or sometimes 'Full Range' fuses.

Figure 1:
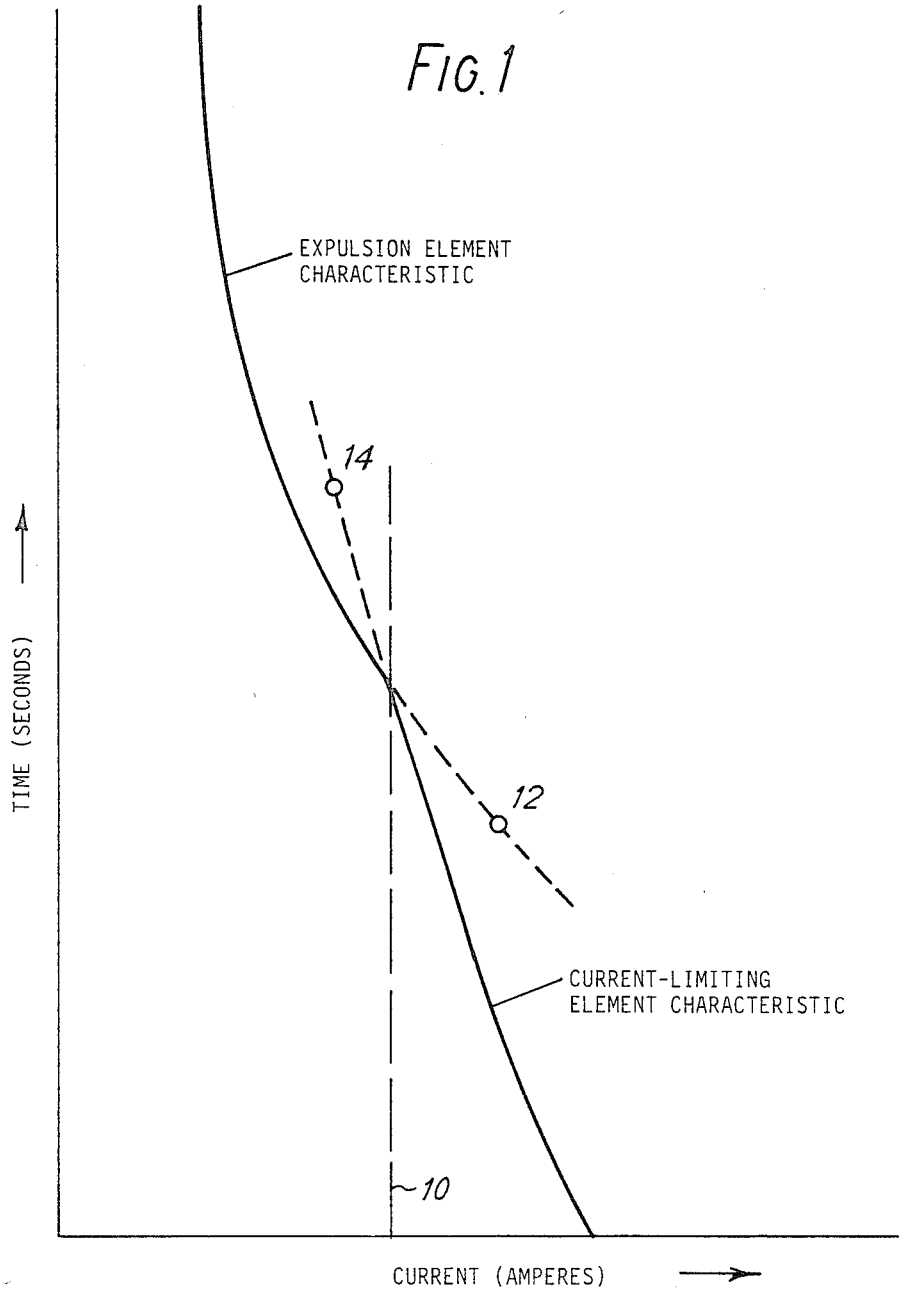

One disadvantage to known General Purpose fuses arises at the so called 'crossover region' where one fuse part takes over the breaking duty from the other fuse part. The two parts have slightly differently shaped time current characteristic curves which intersect at the crossover point 10 as shown in FIG. 1. The design has to ensure that there is an adequate safe margin at this crossover point i.e. that the maximum safe breaking current 12 of the expulsion element portion is well to the right (as viewed) of the crossover current and that the minimum safe breaking current 14 of the current limiting portion is well to the left (as viewed) of the crossover point.

The maximum breaking current of the expulsion portion is relatively constant for a given design and normally has a value below 1000 amperes.

The minimum safe breaking-current of the current limiting element portion is a variable. Amongst other parameters it is a direct function of the cross-section of the element strip. For larger current ratings (say in excess of 10 amperes) the greater cross-section of strip required may result in a minimum safe breaking current to the right of the crossover point—thus introducing a region of unsafe operation into the fuses operating characteristic.

The interconnection of the two fuse parts is necessary to avoid a condition in the crossover region whereby, as each parallel element melts successively, the current density in the remaining elements rises until it is possible for the final element to operate on its current-limiting portion but at a value of current just below its minimum safe breaking value.

The use of two part fuses having an interconnector tends to result in a complex and costly fuse. Further, the presence of the interconnection tends to inhibit simultaneous operation of current-limiting and expulsion elements in the crossover region.

It is an object of the present invention to provide a General Purpose fuse in which the need for element interconnection is removed.

A further object of the invention is to provide a General Purpose fuse having fewer parallel elements for a given current rating and which is of simpler and lower-cost construction than presently available General Purpose fuses.

According to the broadest aspect of the present invention there is provided a General Purpose fuse having two fuse parts the first of which serves as a current limiting part at high fault currents and the second of which serves as a current limiting part at lower fault currents, each fuse part comprising at least one monolithic ribbon-like fuse element common to the two fuse parts, the length of the or each element in the first part having a plurality of constrictions therein and the length of the or each element in the second part, having a constriction intermediate its ends the longitudinal extent of which exceeds the longitudinal extent of one of the constrictions in the first part.

Conveniently, the constriction is in the form of an elongated notch or slot, the length of which is about 1.25 to 5 times that of each hole or notch in said first fuse part.

The reduced cross section of the strip at the constriction in the second fuse part may be the same as or greater than the reduced cross section at one of the constrictions in the first fuse part.

In the preferred embodiment of the invention the constriction is located in a central region of the second part and ideally at the geometric centre thereof. In the preferred embodiment also, there is a single constriction, the remaining length of the element in the second part having a uniform cross section throughout.

However, where a specific time-current characteristic is required in a given fuse, an additional constriction or constrictions may be provided within the second part at a position or positions remote from the ends thereof. Any such additional constriction may have a length greater than those in the first postion.

Preferably the second part includes an 'M' effect overlay but may, less conveniently, include a series connected length of a low melting point metal such as tin wire.

The invention provides a General Purpose fuse having elements of monolithic construction thus considerably simplifying manufacture over the existing two part fuse construction. It follows also that the invention enables the interconnector between the two fuse parts to be dispensed with.

Figure 2:
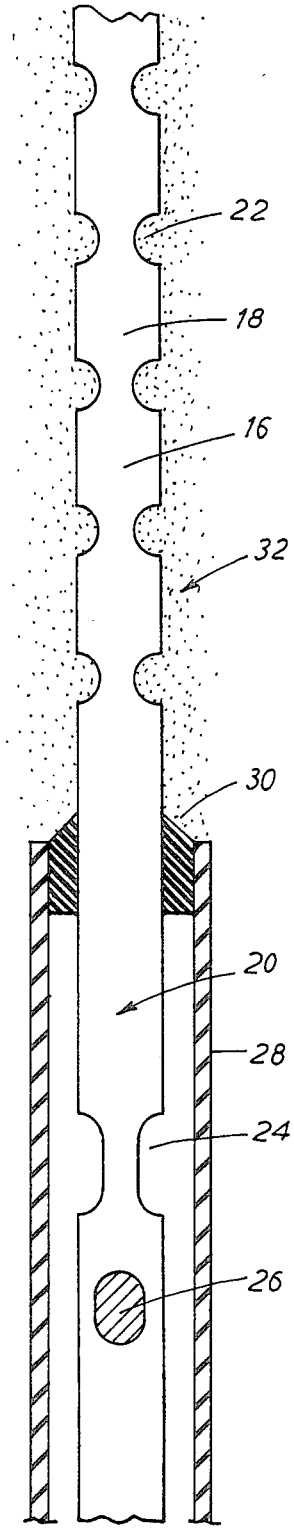
Figure 3:
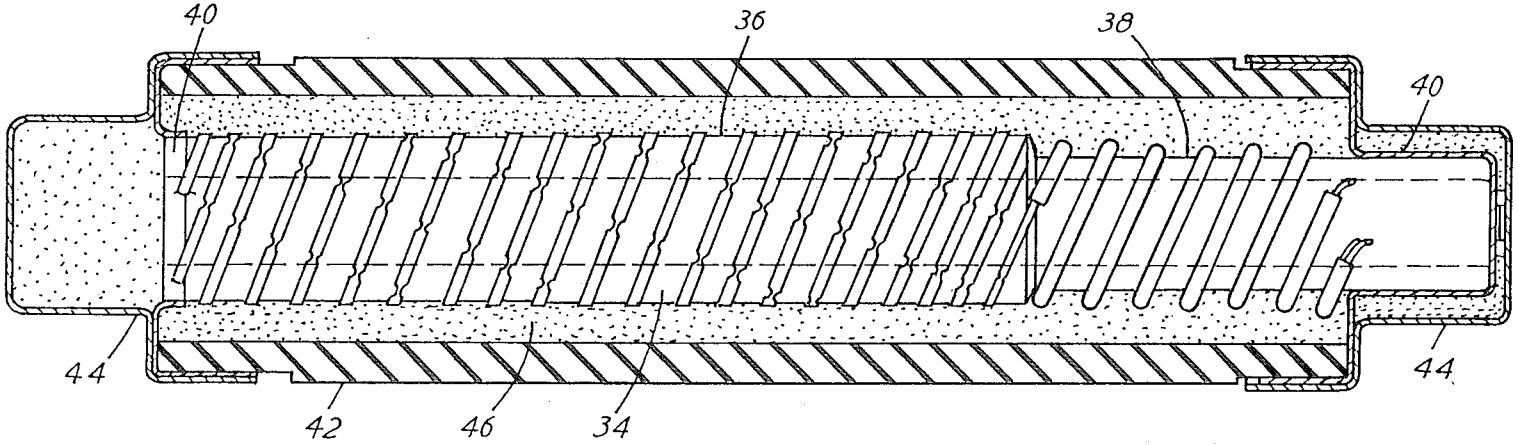
Figure 4:
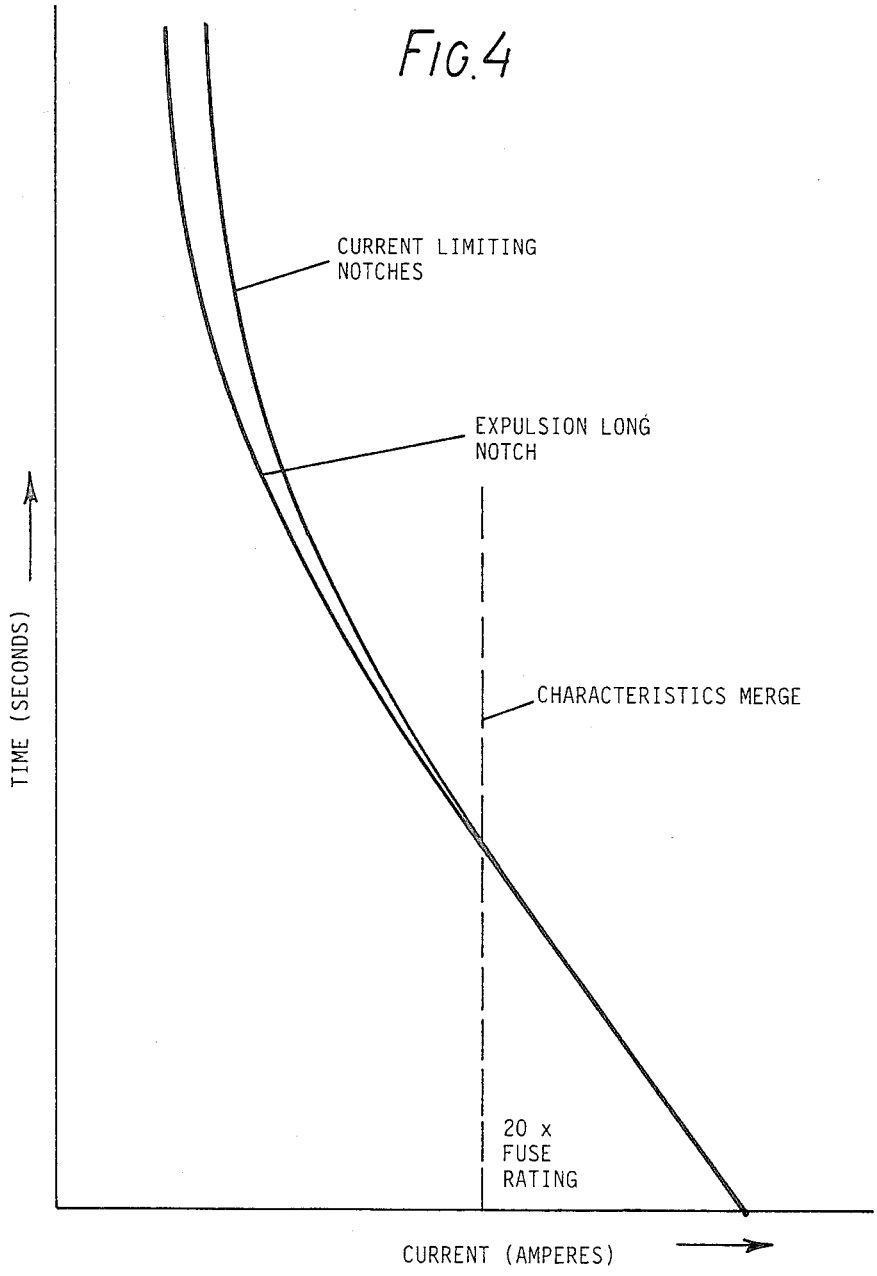

The invention will now be described further by way of example with reference to FIGS. 2, 3 and 4 of the accompanying drawings in which:

FIG. 2 shows diagrammatically a monolithic element from a General Purpose fuse in accordance with the invention, FIG. 3 is a section view of a General Purpose fuse in accordance with a preferred embodiment of the invention, and FIG. 4 shows the time-current characteristic for the fuse of FIG. 3.

In FIG. 2 a monolithic ribbon-like fuse element, designated 16, is of copper or silver strip and has a current limiting part 18 and an expulsion part 20. The current limiting part 18 has a plurality of pairs of opposed notches 22 extending over its length.

The expulsion part 20 has a length of about one-fifth that of the current limitation part. Mid-way along the length of the expulsion part 20 there is a constriction which reduces the strip cross section by an equal or slightly less amount as compared to the corresponding reduction in the current limiting part 18. As an example, the width of the strip at a pair of notches on the current limiting portion is 0.5 mm and the width at the pair of notches on the expulsion portion lies between 0.5 mm and 0.6 mm. The longitudinal extent of the notches 24 is 1.25 to 5.0 times greater than that of the notches 22.

An overlay of low-melting alloy ('M' effect) 26 is placed on the strip adjacent to the expulsion element notches 24. A flexible insulating sleeve 28 of silicone rubber is placed over the expulsion portion of the element and the ends sealed at 30 to prevent ingress of granulated quartz (from fuse filler). The sleeve may be re-inforced by an overwrap of glass-roving or similar to increase the bursting strength during fuse operation.

Referring now to FIG. 3, the complete element assembly 32 is helically wound upon a stepped ceramic element former shown generally as 34. The ceramic former has a portion of larger diameter 36 upon which the current-limiting portion of the element is wound and a portion of smaller diameter 38 upon which the sleeve-enclosed expulsion portion is wound. The ends of the element are electrically connected to terminal members 40 at each end of the element former. The former with its element is enclosed in a fuse barrel 42 of ceramic or other suitable material. The ends of the fuse are closed by metallic end-caps 44 to which the element former terminal members are also connected. The fuse barrel is filled with granulated quartz 46.

Where necessary, in order to achieve larger current rating, more than one element assembly may be wound upon the former. Although attached at each end to the terminal members, such parallel-connected element assemblies are not interconnected at the junctions of their expulsion/current-limiting portions.

The operation of the element is as follows: at low values of fault current (say less than 6 times the current rating of the fuse) the low melting alloy on the expulsion portion of the element melts, forms a eutectic compound with the element material and eventually causes melting and separation of the element within the flexible sleeve. The resulting arc is extinguished within the sleeve by the expulsion process.

At somewhat higher values of fault current (say in the range 6–20 times fuse rated current) there is insufficient time for the M-effect alloy to cause melting of the element strip. However operation still takes place at the required point within the flexible sleeve due to melting of the long notch or slot placed mid-way on the expulsion element.

FIG. 4 shows that the long notch or slot can be so proportioned as to ensure that, over the required band of fault-currents, melting of the element takes place at this notch within the sleeve and not at any of the current-limiting notches or holes. The risk which formerly existed of the current-limiting portions attempting to clear fault currents of values less than their minimum breaking current is thereby eliminated and single elements can be safely made of greater cross-section, hence higher current-rating than was formerly possible.

At values of fault current greater than 20 times fuse rated current, while initial melting still takes place at the single slot or notch within the expulsion sleeve, this is followed immediately by melting at some or all of the current-limiting notches or holes. FIG. 4 shows that for values of current much in excess of 20 times fuse rated current, the characteristic melting curves for the single long expulsion notch and the shorter current-limiting notches merge; i.e. melting of all notches takes place simultaneously. At these higher currents, little of the available arc-energy will be expended in the expulsion portion since it has only one notch compared with perhaps 50 to 60 notches on the current-limiting portion.

Breaking tests at full power have been carried-out on fuses according to the invention at test currents over the range 1.4 times rated current to 1,500 times rated current.

Apart from the obvious advantages in terms of reduced cost and greater simplicity of using an integral strip element without interconnection between parallel elements, the invention also makes it possible to produce a given fuse rating with a smaller number of parallel elements thus effecting further cost savings and a useful reduction in physical size.

Whereas in the described embodiment of the invention the sleeve 28 is described as being of silicone rubber, it will be understood that the sleeve may be of any other material having the required electrical and thermal properties. One other suitable material is polytetrafluoroethylene.

Further the ceramic element former 34 is described as being of stepped configuration, in certain fuse designs, it is possible to use an unstepped former of uniform diameter.

I claim:

1. A General-Purpose fuse having first and second fuse parts, said first fuse part serving as current limiting means at high fault currents and said second fuse part serving as current interrupting means at lower fault currents, each fuse part comprising at least one monolithic ribbon-like fuse element common to said fuse parts, said fuse element in said first fuse part having a plurality of longitudinally spaced constrictions of longitudinal extent therein, and said fuse element in said second fuse part having a longitudinally elongated constriction positioned intermediate a first and a second end of said second fuse part, the longitudinal extent of said constriciton in said second fuse part exceeding the longitudinal extent of at least one of said constrictions in said first fuse part, said fuse element being of a reduced cross section at said constrictions with the cross section of said constriction in said second fuse part being the same as or greater than the reduced cross section of said fuse element at at least one of said constrictions in said first fuse part.

2. A fuse as claimed in claim 1 in which each constriction of said element is formed by an elongate notch or slot with the length of said notch or slot in said second fuse part being about 1.25 to 5 times that of said notch or slot of each constriction in 3. A fuse as claimed in claim 1 in which said constriction in said element in said second fuse part is located in a central region of said second fuse part.

4. A fuse as claimed in claim 3 in which there is a single constriction in said second fuse part of said element.

5. A fuse as claimed in claim 1 in which each of said constrictions in the first fuse part is defined by a hole or notch.

6. A fuse as claimed in claim 1 in which the second fuse part includes an 'M' effect overlay.

7. A fuse as claimed in claim 1 in which the second fuse part includes a series connected length of a low melting point metal such as tin.

8. A fuse as claimed in claim 2 in which said constriction in said element in said second fuse part is located in a central region of said second fuse part.

9. A fuse as claimed in claim 1 in which said constriction in said element in said second fuse part is located in a central region of said second fuse part.

10. A fuse in accordance with claim 1 wherein said second fuse part is disposed in a sealed tube.

11. A fuse in accordance with claim 1 wherein said second fuse part is disposed in a sealed tube, and said fuse element including said tube is encased within a filler.

12. A fuse in accordance with claim 1 wherein said second fuse part is disposed in a sealed tube, said fuse element including said tube is wound on a supporting body and encased within a filler.

* * * * *